United States Patent [19]

Vanderplaats

[11] 4,093,892

[45] * June 6, 1978

[54] RING-AND-BAR SLOW WAVE CIRCUITS EMPLOYING CERAMIC SUPPORTS AT THE BARS

[75] Inventor: Norman R. Vanderplaats, Sunnyvale, Calif.

[73] Assignee: Varian Associates, Inc., Palo Alto, Calif.

[ * ] Notice: The portion of the term of this patent subsequent to Apr. 6, 1994, has been disclaimed.

[21] Appl. No.: 609,466

[22] Filed: Jan. 16, 1967

[51] Int. Cl.[2] ..... H01J 25/34

[52] U.S. Cl. ..... 315/3.5; 315/39.3

[58] Field of Search ..... 315/3.5, 39.3

[56] References Cited

U.S. PATENT DOCUMENTS

| | | | |
|---|---|---|---|
| 2,768,322 | 10/1956 | Fletcher | 315/3.5 |
| 2,853,642 | 9/1958 | Birdsall et al. | 315/3.5 |
| 2,885,641 | 5/1959 | Birdsall et al. | 315/3.5 X |
| 3,370,197 | 2/1968 | Dix | 315/3.5 |

*Primary Examiner*—Malcolm F. Hubler
*Attorney, Agent, or Firm*—Stanley Z. Cole; Robert K. Stoddard

[57] ABSTRACT

Ring-and-bar slow wave electronic interaction circuits of the singly and/or doubly connected variety are supported from a surrounding conductive barrel structure via the intermediary of ceramic comb structures which extend along the slow wave circuit. The ceramic "teeth" of the comb structure are brazed at their ends to the connecting bars of the slow wave circuit to enhance thermal conduction from the circuit. The free space between the teeth avoids excessive dielectric loading of the circuit. The "spines" of the ceramic combs are brazed to the barrel to provide good thermally conductive paths from the combs to the barrel for cooling of the slow wave circuit. A microwave tube employing a doubly connected ring-and-bar circuit, supported as aforedescribed, provides a high power structure having a small signal gain bandwidth between 3.7 db points of 6 GHz at Ku band.

6 Claims, 7 Drawing Figures

FIG. 1
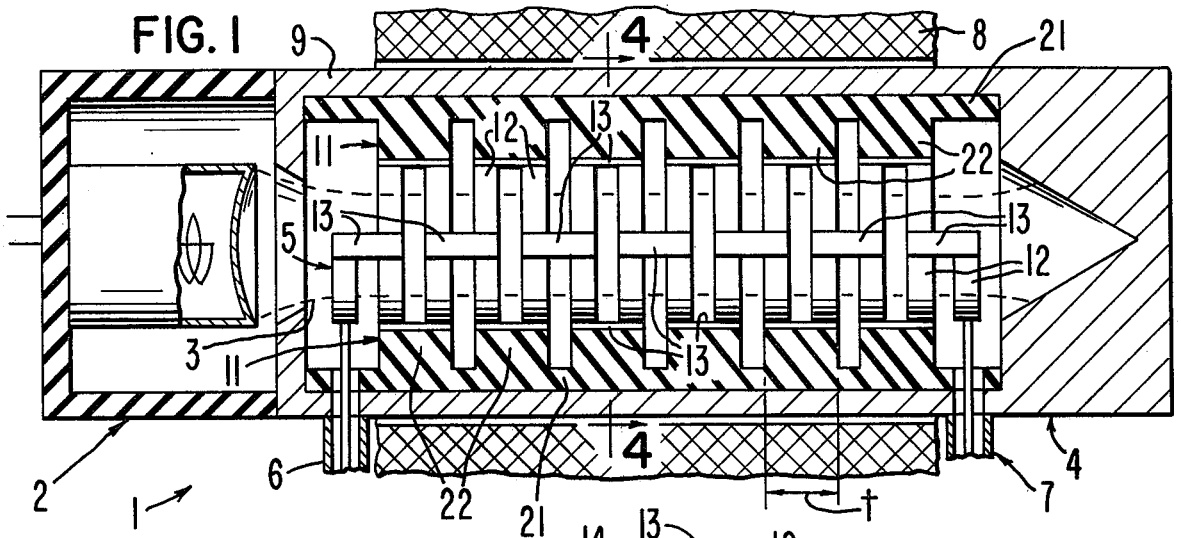
FIG. 2
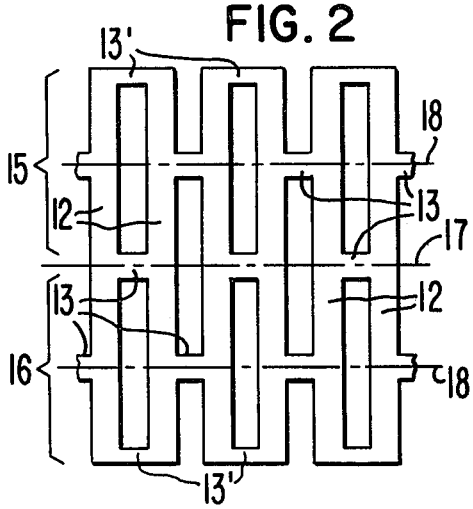
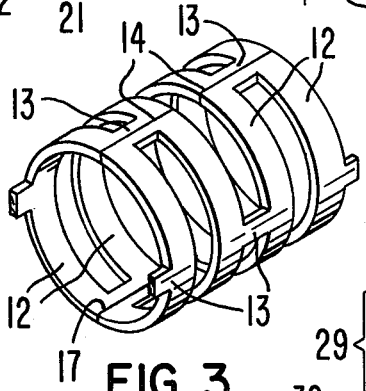
FIG. 3
FIG. 5
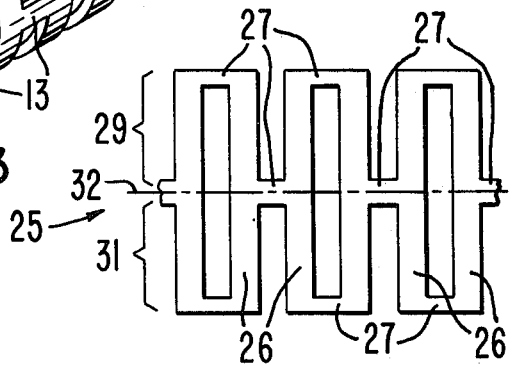
FIG. 6
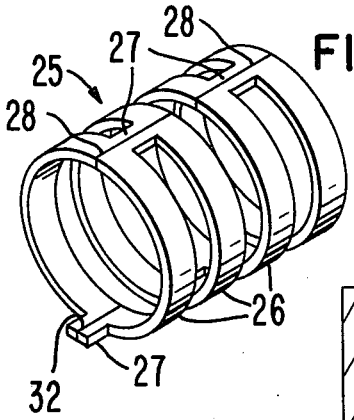
FIG. 4
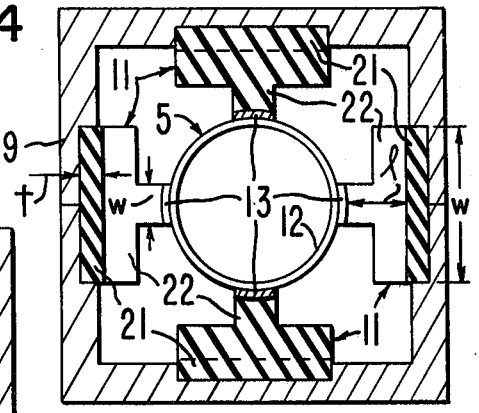
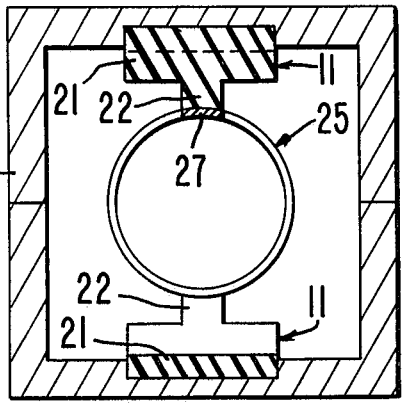
FIG. 7

RING-AND-BAR SLOW WAVE CIRCUITS EMPLOYING CERAMIC SUPPORTS AT THE BARS

DESCRIPTION OF THE PRIOR ART

Heretofore, ring-and-bar slow wave circuits, have employed an array of ceramic rings concentrically mounted on the ring portions of the slow wave circuit for supporting the circuit from a surrounding barrel structure. The ceramic rings were brazed at their inner and outer marginal edges to the circuit rings and barrel structure, respectively. Such a ceramic support structure provided adequate physical support and ample thermal conductivity to the barrel for cooling of the circuit. However, this type of ceramic support becomes more and more difficult to construct as the size of the circuit decreases with increased operating frequency. For example, at Ku band the rings of the circuit are only 0.015 inch in width for a 16 KV beam. Such thin ceramic rings are fragile and likely to fracture during tube manufacture or use. Moreover, at these higher microwave frequencies the ceramic support rings add substantial capacitive loading to the circuit, thereby reducing the electronic interaction with the beam.

BRIEF SUMMARY OF THE INVENTION

In the present invention, a ring-and-bar slow wave circuit is supported from a conductive barrel structure via the intermediary of an array of ceramic finger structure. The ceramic fingers make contact at their ends with the connecting bar portions of the slow wave circuit. In this manner, the ceramic support fingers can have substantially greater thickness in the axial direction of the slow wave circuit than the prior ceramic support rings because they can have a thickness equal to that of two rings and the space therebetween. In addition, the capacitive loading of the slow wave circuit by the ceramic finger structure is substantially less than that obtained by the prior ceramic rings because the ceramic fingers are located only at the positions of the interconnecting bars where the axial electric field of the waves on the circuit are at a minimum.

In a preferred embodiment, the ceramic support fingers are brazed at their ends to the connecting bar portion of the slow wave circuit to facilitate conduction of heat from the circuit through the ceramic fingers to the surrounding barrel structure.

The principal object of the present invention is the provision of improved ring-and-bar slow wave circuits and tubes using same.

One feature of the present invention is the provision of a ceramic support structure for a ring-and-bar slow wave circuit wherein the circuit is supported from a surrounding barrel structure via the intermediary of an array of ceramic fingers which contact the circuit at the connecting bar portions, whereby the support fingers can have increased physical thickness without excessively capacitively loading the slow wave circuit.

Another feature of the present invention is the same as the preceding feature wherein the ceramic support fingers are brazed at their ends to the connecting bar portions of the circuit to enhance thermal conductivity from the circuit through the support fingers for cooling of the circuit.

Another feature of the present invention is the same as any one or more of the preceding features wherein the ceramic support fingers are part of a comb-shaped ceramic support structure disposed with the spine of the comb structure abutting the surrounding barrel structure.

Another feature of the present invention is the same as any one or more of the preceding features wherein the ceramic support is made of alumina, beryllia or boron nitride.

Another feature of the present invention is the same as any one or more of the preceding features wherein the ring-and-bar circuit is a doubly connected ring-and-bar circuit.

Other features and advantages of the present invention will become apparent upon a perusal of the following specification taken in connection with the accompanying drawings wherein:

BRIEF DESCRIPTION OF THE DRAWINGS

FIG. 1 is a longitudinal sectional view, partly schematic, of a portion of a microwave tube employing features of the present invention, FIG. 2 is a plan view of a slow wave circuit of the type depicted in FIG. 1 before it is formed into a tubular shape, FIG. 3 is a perspective view of the slow wave circuit of FIG. 2 after it is formed into a tube, FIG. 4 is a sectional view of the structure of FIG. 1 taken along line 4—4 in the direction of the arrows, FIG. 5 is a plan view of an alternative slow wave circuit to that shown in FIG. 2, FIG. 6 is a perspective view of the slow wave circuit of FIG. 5 after it is formed into a tube, and FIG. 7 is a sectional view similar to that of FIG. 4 showing the alternative circuit of FIGS. 5 and 6.

DESCRIPTION OF THE PREFERRED EMBODIMENTS OF THE INVENTION

Referring now to FIG. 1, there is shown a microwave tube 1 incorporating the features of the present invention. The tube 1 includes an electron gun assembly 2 for forming and projecting a beam of electrons 3 over an elongated beam path to a beam collector structure 4. A slow wave circuit 5 is disposed along the beam path for electronic interaction with the beam 3. An input coupler 6 couples microwave energy onto the slow wave circuit 5. The electronic interaction with the beam produces amplification of the signal wave on the slow wave circuit 5. The amplified signal is extracted from the circuit 5 via an output coupler 7 and fed to a signal utilization device, not shown.

An electric solenoid 8 coaxially surrounds the tube 1 for producing an axially directed magnetic field for focusing the beam 3 through the slow wave circuit 5. The tube 1 has an evacuated envelope structure comprising a hollow barrel structure 9 closed at one end by the gun assembly 2 and closed at the other end by the beam collector structure 4.

Four axially directed ceramic comb structures 11, spaced at 90° intervals around the periphery of the slow wave circuit 5, and shown in FIG. 4, serve to support the slow wave circuit 5 from the barrel structure 9.

The slow wave circuit 5 may take any one of a number of different forms of helix derived geometries. For example, the circuit 5, which is depicted in FIGS. 1-4, is a doubly connected ring-and-bar circuit. The circuit comprises an array of coaxially aligned axially spaced rings 12 as of molybdenum or copper. Adjacent rings 12 are connected together at two diametrically opposed places by connecting bars 13 as of molybdenum or copper. As the circuit advances from ring to ring, the position of the pair of connecting bars 13 on the ring rotates by 90° around the ring 12.

A convenient way to fabricate the circuit 5 of FIGS. 1–4 is to photoetch the circuit 5 from a sheet of metal as shown in FIG. 2. The photoetched sheet is then rolled into a tubular form as shown in FIG. 3. The mating marginal edges of the sheet form a seam 14 which need not be physically contacting or permit electrical conduction thereacross. As an alternative, the circuit 5 may be formed by photetching two halves 15 and 16 as depicted in FIG. 2. The halves 15 and 16 are then formed into semi-cylindrical members and jigged together. In this case, there will be two seams 14 and 17, see FIG. 3. Neither of these seams 14 or 17 need be physically contacting nor permit electrical conduction thereacross. If desired, the pattern could also be separated along lines 17 and 18 to separate the circuit into four 90° segments of a tube. These segments need not be physically contacting at their adjoining edges.

Thus, in certain versions of the ring-and-bar slow wave circuit 5, the rings 12 need not be completely closed conductive loops but may be made up of conductive segments with the composite of the segments generally having a ring-shape. As used herein the term "ring" is defined to mean not only a completely closed conductive loop but geometries which include conductive ring segments assembled in a generally ring shaped geometry and the assembled segments need not form a closed conductive loop.

As an alternative way to form the ring-and-bar slow wave circuit 5, the rings 12 may be jigged together with the bars 13 and the assembly brazed to form the composite slow wave structure 5.

Once the slow wave circuit 5 has been formed, it is brazed into the ceramic comb supports 11 which are in turn brazed to the barrel structure 9.

The ceramic comb supports 11 comprise a spine portion 21 with finger portions 22 projecting from the spine toward the circuit 5. The ends of the finger portions 22 are brazed to the connecting bar portions 13 of the circuit 5. The fingers 22 at their points of connection to the circuit are approximately of the same width as the connecting bars 13. The fingers 22 have a thickness corresponding to the thickness of two rings 12 plus the space therebetween.

The spine portions 21 of the combs 11 are brazed into grooves in the sides of the barrel support structure 9. The comb structures 11 are preferably made of a refractory ceramic insulating material having moderate to good thermal conductive properties. Suitable ceramics are beryllia, alumina, and boron nitride beryllia or boron nitride being preferred because of their better thermal conductivity. The barrel structure 9 is made of a material having a coefficient of linear thermal expansion substantially equal to that of the ceramic combs 11. Suitable barrel materials are titanium or a copper-tungsten matrix formed by a porous tungsten body infiltrated with copper and comprising 65% by volume of tungsten and 35% by volume of copper. The barrel 9 is conveniently made in two trough-shaped pieces which are brazed together.

In a typical example of a Ku band doubly connected ring-and-bar circuit 5, the rings 12 have an inner and outer diameter of 0.100 inch and 0.110 inch, an axial width of 0.008 inch and are spaced 0.016 inch apart. The bars 13 are 0.025 inch wide 0.005 inch thick and 0.008 inch long. The comb fingers 22 are 0.035 inch long $l$ 0.025 inch wide $w$ and 0.024 inch thick $t$. The spine 21 is 0.075 inch wide $w$ 0.020 inch thick $t$ and 2.5 inch long.

The advantage of the comb support structure 11, connected at the bars 13, over the prior ceramic ring support, at the rings 12, is that the fingers 22 can be about three times as thick as the ceramic rings and, thus, are much less fragile than the prior ceramic rings. Also the fingers are located at the bars 13 where the axial electric fields of the circuit are relatively weak and thus, the circuit 5 is not excessively loaded by the dielectric support structure. A tube design using the doubly connected ring-and-bar circuit of FIG. 1 and the comb support provided 6.0 GHz bandwidth between −3.7 db points at Ku band.

Referring now to FIGS. 5–7, there is shown an alternative ring-and-bar circuit 25. This is the more conventional ring-and-bar circuit wherein adjacent rings 26 are connected together by bars 27 at only one place, which place of connection rotates by 180° per period of the circuit as the circuit advances from ring to ring.

The circuit 25 may be fabricated by photoetching a flat metal sheet into a pattern as shown in FIG. 5 and then rolling the sheet into a tubular form as shown in FIG. 6. A seam is formed at 28 and this seam 28 need not permit electrical conduction thereacross. Alternatively, the photoetched pattern of FIG. 5 could have been made in two halves 29 and 31 as separated along line 32. The two halves are then formed into two semi-cylindrical members and jigged together as shown in FIG. 6. The two seams 28 and 32 need not permit electrical conduction thereacross. The slow wave circuit 25 is then brazed into the comb support structures 11, as shown in FIG. 7, with the fingers 22 of the combs 11 being brazed to the connecting bar portions 27 and with the spines 21 of the combs being brazed into the barrel structure 9.

Since many changes could be made in the above construction and many apparently widely different embodiments of this invention can be made without departing from the scope thereof it is intended that all matter contained in the above description or shown in the accompanying drawings shall be interpreted as illustrative and not in a limiting sense.

What is claimed is:

1. In a microwave tube apparatus, means for forming a slow wave circuit having an array of spaced coaxially aligned conductive ring portions conductively connected together by an array of conductive bar portions, means for forming and projecting a beam of electrons axially through said ring portions for electronic interaction with the microwave fields of said slow wave circuit, means for forming a barrel structure surrounding said slow wave circuit, means forming an array of ceramic insulative support member portions interposed between said surrounding barrel structure and said slow wave circuit and spaced apart along the axis of said slow wave circuit, the improvement wherein, said support member portions are finger-shaped with the ends of said finger portions supportively contacting said connecting bar portions of said slow wave circuit, said support fingers are the finger portions of a ceramic comb-shaped structure having a spine portion and said finger portions.

2. The apparatus of claim 1 wherein said ceramic support finger portions are brazed to said connecting bar portions.

3. The apparatus of claim 1 wherein said ceramic finger portions have a thickness at their support ends taken in the axial direction of said slow wave circuit which is not substantially in excess of the axial distance subtended by the axial thickness of adjacent ring portions of said circuit and the space therebetween, whereby the support fingers are shielded by the connecting bar portions from the strong electric fields of said slow wave circuit.

4. The apparatus of claim 1 wherein said comb-shaped structure is made of a material selected from the class consisting of beryllia and boron nitride, said finger portions are bonded at their ends to said connecting bar portions of said slow wave circuit, and said comb-shaped structure is bonded along its spine portion to said surrounding barrel structure.

5. The appartus of claim 1 wherein therein are a plurality of said support finger arrays positioned around the periphery of said slow wave circuit.

6. The apparatus of claim 5 wherein said slow wave circuit is a double connected ring-and-bar circuit.

* * * * *